US007472666B1

(12) United States Patent
Richard et al.

(10) Patent No.: US 7,472,666 B1
(45) Date of Patent: Jan. 6, 2009

(54) SUPPORT FRAME FOR TARPAULIN USED FOR SHELTERING BOATS AND OTHER OBJECTS

(76) Inventors: Robert Richard, 34, Domaine Hajmur, St-Hippolyte, Quebec (CA) J8A 2Y1; Pierre Beaudoin, 225, De Vimy #4, St-Bruno-De-Montarville, Quebec (CA) J3Y 6G9

( * ) Notice: Subject to any disclaimer, the term of this patent is extended or adjusted under 35 U.S.C. 154(b) by 0 days.

(21) Appl. No.: 11/765,419

(22) Filed: Jun. 19, 2007

Related U.S. Application Data

(60) Provisional application No. 60/814,395, filed on Jun. 19, 2006.

(51) Int. Cl.
*B63B 17/00* (2006.01)
*E04H 15/06* (2006.01)

(52) U.S. Cl. ..... 114/361; 135/88.01

(58) Field of Classification Search ..... 114/361; 135/88.01, 88.03, 88.13, 88.15, 121, 122, 135/141, 142, 143, 144
See application file for complete search history.

(56) References Cited

U.S. PATENT DOCUMENTS

| | | | | |
|---|---|---|---|---|
| 3,106,931 | A * | 10/1963 | Cooper | 114/361 |
| 3,550,311 | A | 12/1970 | Fouquart | |
| 4,352,255 | A | 10/1982 | Warehime | |
| 5,255,698 | A * | 10/1993 | Riley | 135/142 |
| 5,944,039 | A | 8/1999 | Bergeron | |
| 6,353,969 | B1 * | 3/2002 | LeMole | 16/352 |
| 6,978,731 | B2 | 12/2005 | Erbetta | |
| 2007/0144425 | A1 * | 6/2007 | Buckley | 114/361 |

* cited by examiner

*Primary Examiner*—Jesus D Sotelo

(57) ABSTRACT

A Support frame for tarpaulin for use over boats in storage uses easy to assemble tube elements that are easily attached together without the use of tools in order to create a structure that allows for the laying of a tarpaulin.

4 Claims, 5 Drawing Sheets

Figure 1:
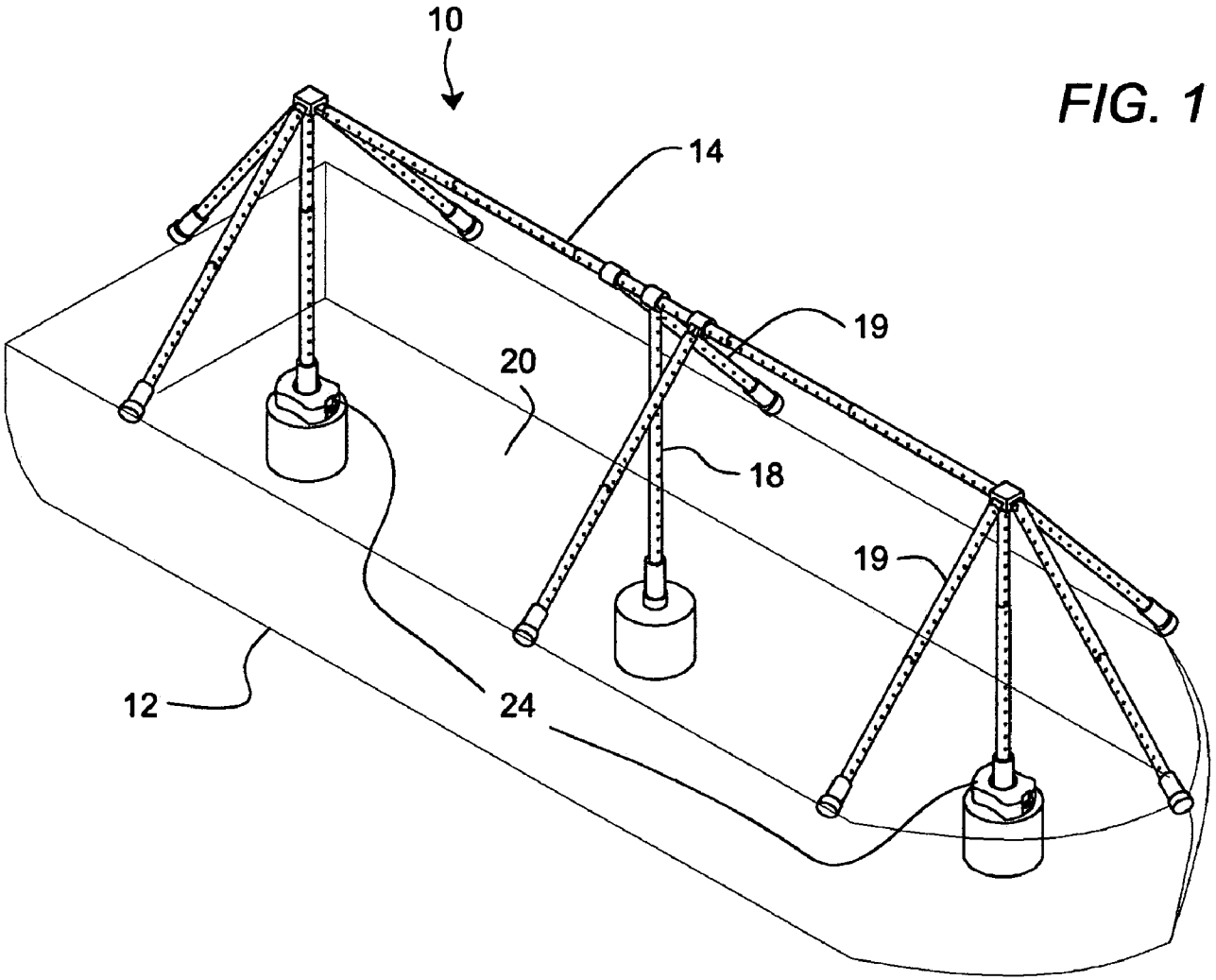

40
22

38
24

SUPPORT FRAME FOR TARPAULIN USED FOR SHELTERING BOATS AND OTHER OBJECTS

This application claims priority based of provisional application 60/814,395 filed Jun. 19, 2006

BACKGROUND OF THE INVENTION

1. Field of the Invention

The invention relates generally to frames for covers and tarpaulins but more particularly to a support frame structure used to support a tarpaulin to shelter boats and other objects.

2. Background of the Invention

Over the years, many types of covers have been devised for protecting boats from the elements. These covers come in two categories: Overnight covers and seasonal covers. Seasonal covers are for long term protection for off season storage of boats as is generally the practice in colder climates.

For short term overnight cover, some ingenious inventors have adapted the frame and cover so that they serve the double duty of acting as a protection for the boat as well as a tent for overnight camping.

As one can imagine, the structure can take out various guises, the most popular being that of bow like frame elements disposed at intervals along the length of the boat and getting their convex bow from the insertion tension they get from being fitted across the width of the boat. A covering tarp can then be applied over the frame. Other devices use posts or combination posts and bows.

In areas where the amount of snow is quite high, bow like frame structures do not have enough of a slope to prevent snow accumulation, the structure is thus liable to collapse. There is therefore a need for a simple to erect, stable, strong structural frame for a tarpaulin which has a steep enough slope to prevent high snow accumulation. Besides using odd pieces of lumber and an assortment of tarpaulins nailed or stapled to the lumber in a rather precarious assembly, there is no type of commercially available system that allows for repeated assembly and disassembly year after year using the same components.

SUMMARY OF THE INVENTION

It is a main object of this invention to provide for a simple to use system for offering a seasonal protection for a boat.

In order to do so, the invention uses easy to assemble tube elements that are easily attached together without the use of tools in order to create a structure that allows for the laying and tying down of a tarpaulin.

The support frame for tarpaulin comprises at least one horizontally positioned beam and each of the beam consisting of at least one tube. The tube being defined as either a male tube or a female tube. The male tube, female tube configured and sized to allow for the male tube to slidingly insert into the female tube so as to create a sliding connection between the male/female tubes.

The beam is supported by a plurality of posts which are also made out of slidingly connected tubes. The posts have an upper and a lower end and their lower end is frictionally inserted into a base by way of a base hole. Angled posts are connected to the beam by way of clips. The angled posts rest on the side of the boat.

A hub to allow for a post and a plurality of angled posts to connect thereto and be oriented a variable amount of degree to allow for an easy adjustment for a variety of possible sizes by way of flexible tentacles. The flexible tentacles consisting of two blocks joined together by way of a resiliently deformable tongue which allows for the blocks to be selectively angled relative to each other. Couplings consisting of two blocks joined together by way of a resiliently deformable tongue which allows for the blocks to be selectively angled relative to each other. The blocks are frictionally inserted into post, angled post and beam and locked in position by way of a locking pin passing through insertion holes. The locking pin used for also locking two slidingly engaged tubes so that they are locked to a chosen length.

The hub has a central hole to allow for frictional insertion of a top connector which is frictionally inserted onto the top part of a post.

The clips open clamshell style so as the be attachable to the beam.

Clips are configured and sized with ends that are insertable into male or female tubes, once the clips are closed. Hooks are located on the hub, the clip, the top connector and the locking pin and are used for passing stretchable tie downs.

The support frame for tarpaulin has the method of installation consisting in the steps of:

A user pre adjusts components such as the beam by connecting male tubes connected either by way of couplings or by slidingly connecting between male tubes and female tubes so that the overall length of the beam is made adequate for the length of the boat. The length of the beam is locked in by way of the locking pins. The length of the posts is also adjusted by slidingly protracting or retracting the male/female tubes and locking them with locking pins. The user then places bases at various locations in the boat; inserts the posts into the base hole by first inserting a pad into one end of the post; and frictionally inserting the top connector at its opposite end. The top connector goes into the central hole of the hub.

between each post runs the beam which is connected in one of three ways;

to a hub at each end;

a hub at one end and a connector at the opposite end;

a connector at each end.

Posts and angled posts are attached to the beam by way of clips; once the frame is complete, tie downs are used to hold it firmly in place by way of tie downs attached to the hooks located on the clips, the hub, the top connector and the locking pins, on one end and to various hookable parts on the boat at the other end. The tarp is then placed on top of the frame and securedly attached onto the boat by a rope.

The couplings can connect male to male tubes or male/female tubes.

The post and angled post have their lower ends fitted with pads which are frictionally inserted.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention. There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

BRIEF DESCRIPTION OF THE PREFERRED EMBODIMENT

FIG. 1 Isometric view of the support frame over a boat.

Figure 2:
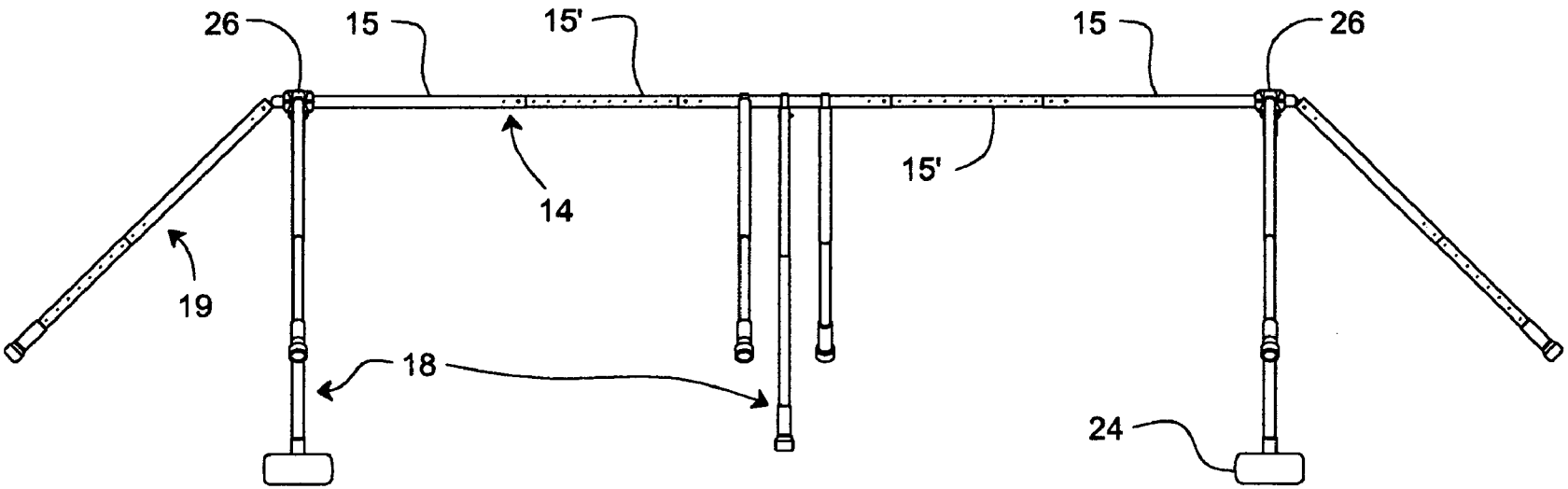

FIG. 2 Side view of the support frame.

Figure 3:
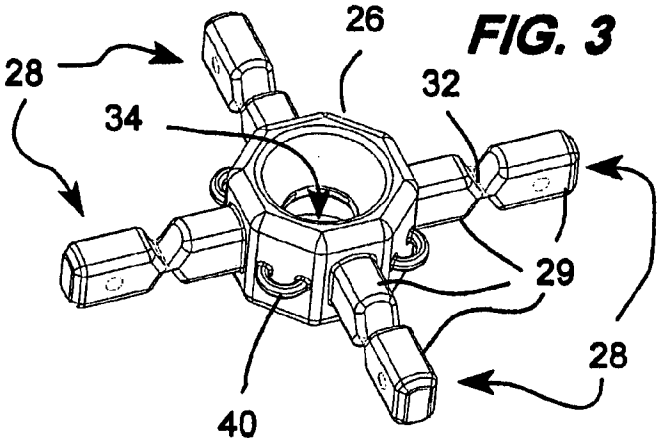

FIG. 3 Isometric view of hub.

Figure 4:
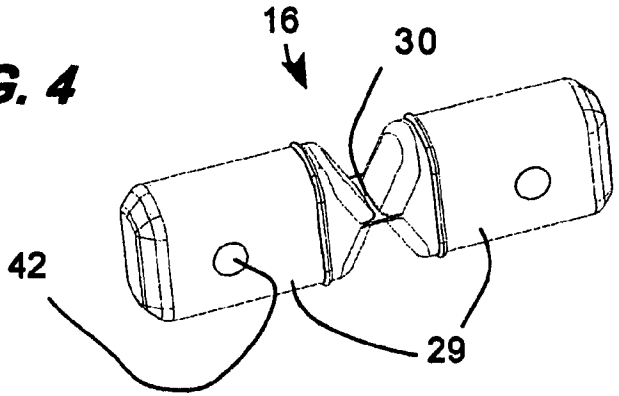

FIG. 4 Isometric view of a coupling.

Figures 5A, 5B, 5C, 7:
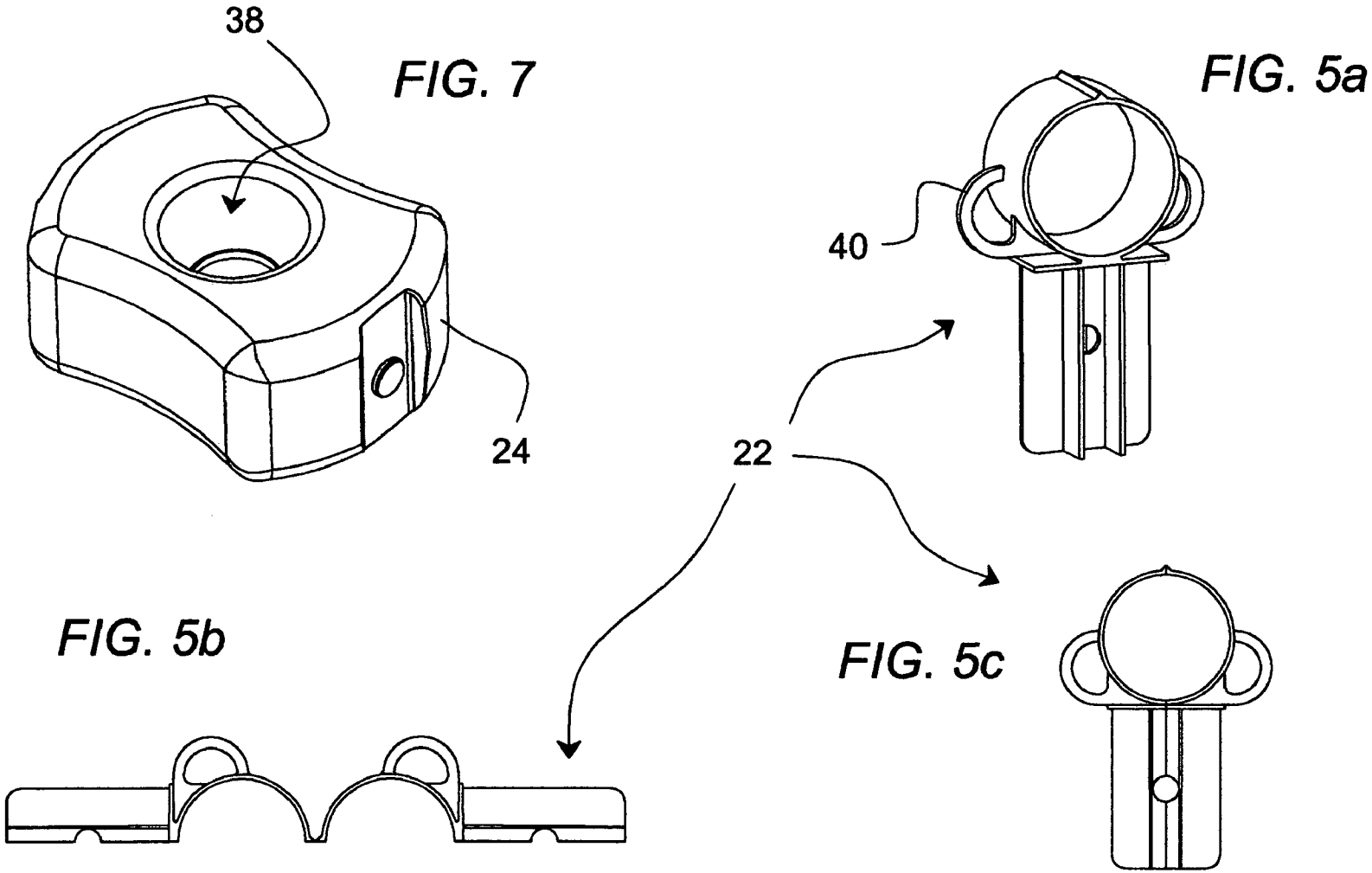

FIGS. 5*a-c* Isometric and side views of clip open and closed, respectively.

Figure 6:
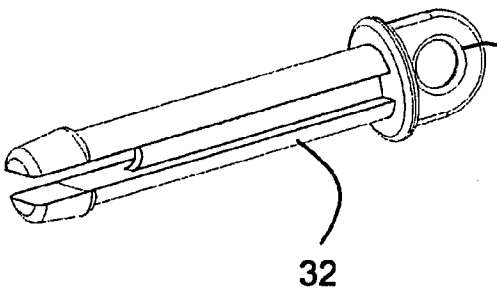

FIG. 6 Isometric view of locking pin.

FIG. 7 Isometric view of base.

Figure 8:
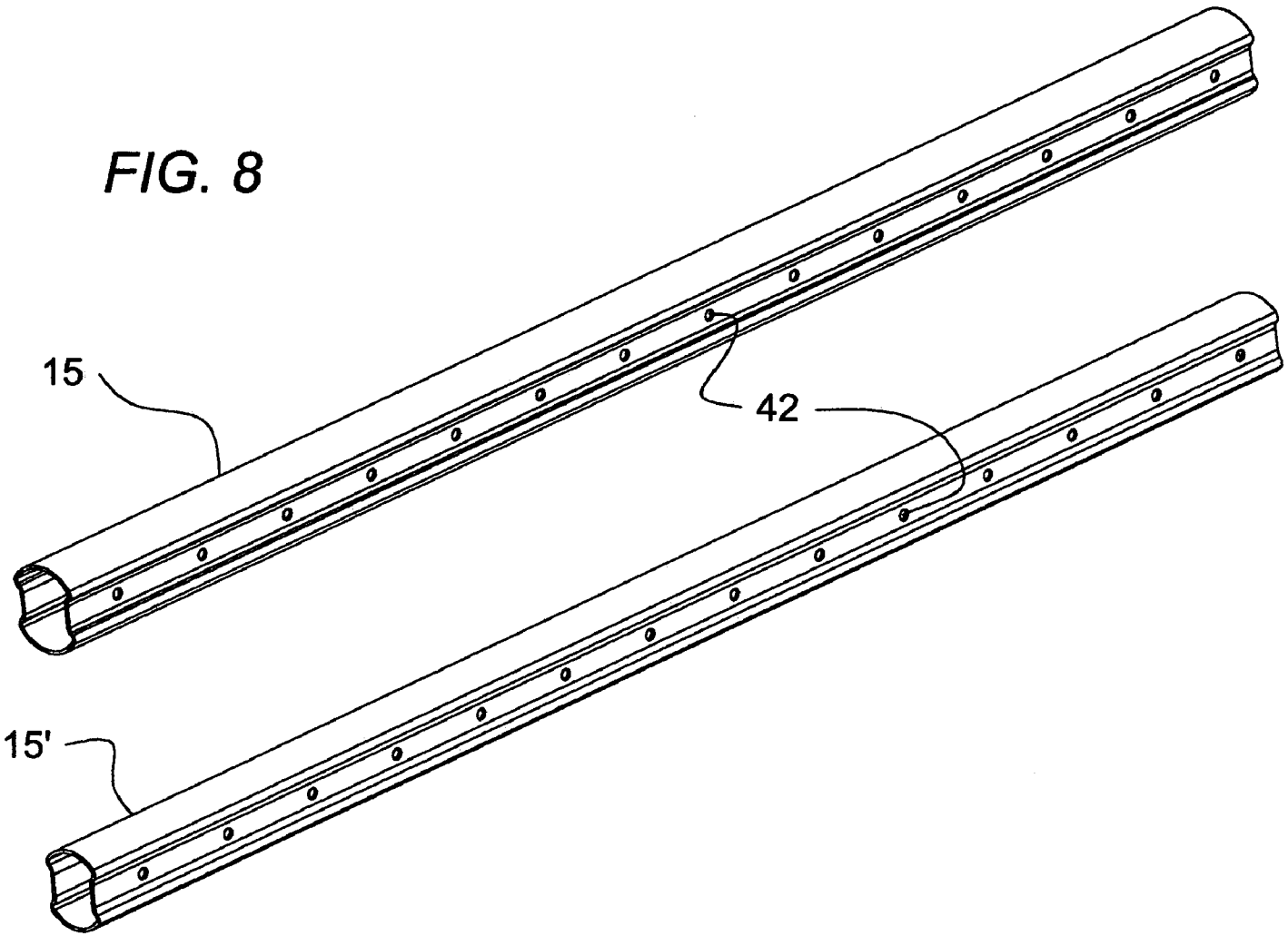

FIG. 8 Isometric view of tubes.

Figure 9:
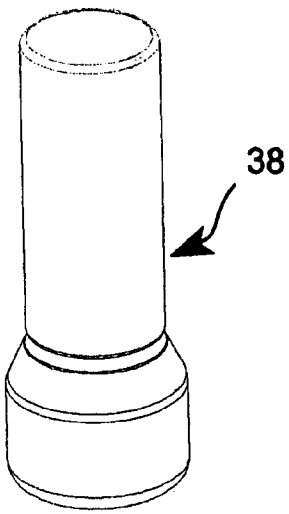

FIG. 9 Isometric view of base pads.

Figure 10:
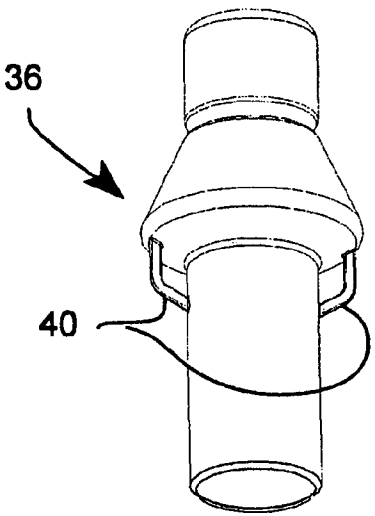

FIG. 10 Isometric view of top connector.

DETAILED DESCRIPTION OF THE PREFERRED EMBODIMENT

A support frame (10) is set over a boat (12) and consists of at least one horizontally positioned beam (14) but generally more beams (14) which consists of two types of tubes (15, 15') which are slidingly connected together due to the fact that one tube is narrower than the other tube so that the larger tube is known as the female tube (15) and the narrower tube which fits inside the female tube is the male tube (15'). Alternatively, a coupling (16) can be used to connect two male (15') or two female (15) tubes together end to end in order to construct the beam (14).

The beam (14) is supported by posts (18) which are also made out of slidingly connected tubes (15, 15'). The posts (18) have their lower ends inserted into bases (24) by way of a base hole (25). The bases (24) rest on the floor (20) of the boat (12) or any other suitable generally flat place such as the deck or cabin roof (not shown). In order to provide support for the tarpaulin (not shown), a series of angled posts (19) are connected to the beam (14) by way of clips (22). These angled posts (19) rest on the side of the boat (12), either dangling outside the hull or resting on the edge of the hull. In order not do damage the finish of the hull, the angled posts (19) have their lower ends fitted with pads (38) which are frictionally inserted. The same pads (38) are also used at the lower end of posts (18) that are inserted into the bases (24).

A hub (26) is located on at least one end of the boat (12) to allow for a post (18) and a plurality of angled posts (19) to connect and be oriented a variable amount of degree to allow for an easy adjustment no matter the size of the boat (12). This is done by way of flexible tentacles (28) which are mechanical equivalents to the couplings (16). The couplings (16), like the flexible tentacles (28) consist of two blocks (29) joined together by way of a resiliently deformable tongue (30) which allows for the blocks (29) to be selectively angled relative to each other. In both cases, the blocks are frictionally inserted into posts (18), angled posts (19) and beams and locked in position by way of a locking pin (32) passing through insertion holes (42). This locking pin is also used for locking two slidingly engaged tubes (15, 15') so that they are locked to a chosen length. The locking pin (32) operates by frictional insertion as is known in the art for similar types of devices.

The hub (26) has a central hole (34) which allows for frictional insertion of a top connector (36) which is frictionally inserted onto the top part of a post (18).

The clips (22) open clamshell style so as the be attachable to the beams (14). Once the clips (22) are closed, angled posts (19) are frictionally inserted into the clips (22).

Hooks (40) are located on various parts such as the hub (26) the clips (22) and the locking pins (32) and are used for passing stretchable tie downs (not shown), commonly referred to as bungee cords and which have the general characteristic of being resiliently stretchable in length and having open hooks at both ends. One such open hook is hooked into the hooks (40) and the other open hook is hooked to a part of the boat (120 such as a railing or handles, cleats, etc. . . . These tie downs are what holds the frame structure (10) in place much like ropes will tie down a tent. Once the frame structure (10) is thus secured, the tarp can be installed and tied down with a rope. This aspect of the invention is well known in various fields and need not be further discussed here.

The base (24) can be filled-in with sand, concrete or other such material in order to be heavy.

The couplings (16) can connect male to male tubes (15') or male/female tubes (15' 15).

In order to install the support frame (10), a user will pre adjust certain components such as the beam (14) by connecting male tubes (15') connected either by way of couplings (16) or by slidingly connecting between male tubes (15') and female tubes (15) so that the overall length of the beam (14) is made adequate for the length of the boat (12). The length of the beam (14) being locked in by way of the locking pins (32). The length of the posts is also adjusted by slidingly protracting or retracting the male/female tubes (15', 15) and locking them with locking pins (32). Although all these parts can be assembled at any time, it is preferable to have them pre-assembled so as to speed up the process of instalaltion.

The user then places bases (24) at various locations in the boat (12) insert the posts (18) into the base hole (25) by first inserting a pad (38) into one end of the post (18) and frictionally inserting the top connector (36) at its opposite end. The top connector (36) goes into the central hole (34) of the hub (26). between each post (18) runs the beam (14). Some posts (18) can even rest directly on the floor (20) of the boat (12) but preferably if fitted with pads (38).

The posts (18) and angled posts (19) are attached to the beam (14) by way of clips (22). Once the frame (10) is complete, tie downs are used to hold it firmly in place by way of tie downs attached to the hooks (40), located on the clips (22), the hub (26), the top connector (36) and the locking pins (38), on one end and to various hookable parts on the boat (12) at the other end, as described hereinabove. The tarp (not shown) is then placed on top of the frame (10) and securedly attached onto the boat by a rope. In this fashion, the frame can withstand strong winds and snow accumulation (although most of it will slide off the angled tarp) for an entire season or longer if needed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, failing within the scope of the invention.

The invention claimed is:

1. A support frame for tarpaulin used for sheltering boats and other objects comprising:

at least one horizontally positioned beam;

each said beam consisting of at least one tube;

said tube being defined as either a male tube or a female tube;

the male tube, female tube configured and sized to allow for the male tube to slidingly insert into the female tube so as to create a sliding connection between the male/female tubes;

the beam is supported by a plurality of posts which are also made out of slidingly connected tubes;

the posts have an upper and a lower end and their lower end is frictionally inserted into a base by way of a base hole;

angled posts are connected to the beam by way of dips;

the angled posts rest on the side of the boat;

a hub to allow for a post and a plurality of angled posts to connect thereto and be oriented a variable amount of degree to allow for an easy adjustment for a variety of possible sizes by way of flexible tentacles;

the flexible tentacles consisting of two blocks joined together by way of a resiliently deformable tongue which allows for the blocks to be selectively angled relative to each other;

couplings consisting of two blocks joined together by way of a resiliently deformable tongue which allows for the blocks to be selectively angled relative to each other;

the blocks are frictionally inserted into post, angled post and beam and locked in position by way of a locking pin passing through insertion holes;

the locking pin used for also locking two slidingly engaged tubes so that they are locked to a chosen length;

the hub has a central hole to allow for frictional insertion of a top connector which is frictionally inserted onto the top part of a post;

the clips open clamshell style so as the be attachable to the beam;

clips configured and sized with ends that are insertable into male or female tubes, once the clips are closed;

hooks located on the hub, the dip, the top connector and the locking pin and are used for passing stretchable tie downs.

2. A support frame for tarpaulin as in claim 1 wherein:

the couplings connect male to male tubes or male/female tubes.

3. A support frame for tarpaulin as in claim 1 wherein:

the post and angled post have their lower ends fitted with pads which are frictionally inserted.

4. A method of installation of a support frame for a tarpaulin consisting of the steps of:

adjusting components of a beam by connecting tube elements connected either by way of couplings or by slidingly connecting male tube portions and female tube portions such that the overall length of the beam is adjusted for the length of a boat;

the length of the beam is locked in by means of locking pins;

providing posts with an adjustable length adjusted by slidingly protracting or retracting male/female tube portions and locking them with locking pins;

providing at least one base at a location in the boat;

inserting the at least one post into a base hole by first inserting a pad into one end of the post and frictionally inserting a top connector at the opposite end of the post;

the top connector is inserted into a central hole of a hub;

the beam is connected between each post in one of three ways:

the beam is connected to the hub at each end of the beam; the beam is connected to the hub at one end and a connector is placed at the opposite end of the beam; or, the beam is connected to a connector at each end of the beam;

attaching posts to the beam by means of clips;

providing tie downs to hold the support frame firmly in place by means of the tie downs attached to hooks located on the clips, the hub, the top connector, and the locking pins, on one end and to various hookable parts on the boat at the other end;

and placing a tarp on top of the support frame and securely attached onto the boat by a rope.

* * * * *